United States Patent [19]

Gysling

[11] 4,188,218

[45] Feb. 12, 1980

[54] IMAGES FORMED BY DECOMPOSITION OF TE (II) COORDINATION COMPLEXES

[75] Inventor: Henry J. Gysling, Rochester, N.Y.

[73] Assignee: Eastman Kodak Company, Rochester, N.Y.

[21] Appl. No.: 863,199

[22] Filed: Dec. 22, 1977

Related U.S. Application Data

[63] Continuation-in-part of Ser. No. 703,405, Jul. 8, 1976, abandoned.

[51] Int. Cl.[2] ..... G03C 1/00; G03C 1/48

[52] U.S. Cl. ..... 430/495; 430/353; 430/415; 430/417; 430/617

[58] Field of Search ..... 96/95, 88, 76 R, 48 HD, 96/48 PD, 48 QP, 49, 50 R, 91 R, 92; 428/913, 411

[56] References Cited

U.S. PATENT DOCUMENTS

| | | | |
|---|---|---|---|
| 1,939,232 | 12/1933 | Sheppard et al. | 96/88 |
| 3,130,052 | 4/1964 | Dippel et al. | 96/48 PD |
| 3,700,448 | 10/1972 | Hillson et al. | 96/88 |
| 3,819,377 | 6/1974 | Kose et al. | 96/48 HD |
| 4,076,537 | 1/1976 | Tsuboi | 96/88 |

OTHER PUBLICATIONS

Foss, Acta chem. Scand., 3 708 (1949).

Sethuraman, et al., Indian J. Chem., 11 288 (1973).

*Primary Examiner*—Won H. Louie, Jr.

*Attorney, Agent, or Firm*—J. Jeffrey Hawley

[57] ABSTRACT

Tellurium images are formed by the decomposition of tellurium (II) coordination complexes in the presence of a catalyst. The complexes are characterized in that at least one of the four coordination positions of the tellurium (II) is occupied by a sulfur containing ligand. Preferred ligands that can be coordinated with tellurium are sulfur containing bidentate anionic ligands. Complexes formed using these preferred ligands are more hydrolytically stable than other tellurium (II) complexes having sulfur containing ligands and yet are still capable of providing catalytic amplification.

9 Claims, No Drawings

IMAGES FORMED BY DECOMPOSITION OF TE (II) COORDINATION COMPLEXES

CROSS-REFERENCE TO RELATED APPLICATION

This is a continuation-in-part of Ser. No. 703,405, filed July 8, 1976, now abandoned.

BACKGROUND OF THE INVENTION

This invention relates to novel photographic processes, elements and physical developer solution. In a particular aspect, it relates to novel tellurium (II) complexes that are stabilized by coordination to various sulfur containing ligands which catalytically decompose in the presence of metal nuclei.

In the photographic field, many different imaging processes are known, ranging from silver halide processes to various "non-conventional" processes such as diazo processes, photopolymerization and various direct printout or photochromic processes. High speed photographic processes are especially useful and are generally characterized by an amplification step. In such processes, a catalyst is generally formed by the exposure of a photosensitive compound and the image or latent image thus formed is then used to catalyze the reduction of a material in a high oxidation state to a visible image in a low oxidation state. In silver halide processes for example, exposure of silver halide to light results in the formation of silver nuclei which then catalyze the further reduction of silver halide to silver in the presence of a reducing agent.

It is known in the art to produce tellurium images by the disproportionation of tellurium dihalides. In U.S. Pat. No. 3,700,448 to Hillson et al, a process wherein a tellurium dihalide undergoes disproportionation to form a tellurium image in the presence of catalytic nuclei and a processing liquid is described. Some unexposed tellurium dihalides of Hillson et al however, are dark in color so that image discrimination is poor. Further, tellurium dihalides are unstable in air and undergo light induced decomposition only when moistened with an organic solvent.

It is also known that certain tellurium (IV) compounds, wherein the tellurium is bonded directly to a carbon atom, undergo reduction to tellurium (0) when incorporated in a matrix with a photoreductant. In British Pat. No. 1,405,628, published Sept. 10, 1975, there is described a process wherein tellurium (IV)

$$(CH_2CC_6H_5)_2Cl_2$$

undergoes unit quantum photoreduction to yield a tellurium (0) image. Because this process is not catalytic, i.e. the tellurium (0) does not catalyze the decomposition of the tellurium (IV) compound, this process is inherently slow thereby limiting its usefulness.

SUMMARY OF THE INVENTION

In accordance with the present invention, there is provided a support having thereon (1) a layer comprising a binder and a compound capable of forming an image of nuclei of one or more metals selected from the group consisting of Te, Pd, Ag and Cu; and (2) a layer comprising a binder and a coordination complex of tellurium (II) and two univalent bidentate sulfur containing ligands, wherein said tellurium (II) is coordinated to said ligand through said sulfur, said layers being in reactive association.

In another aspect of the present invention there is provided a process for forming a visible tellurium image with good definition which comprises the steps of:

(1) forming an image comprising nuclei of one or more metals selected from the group consisting of Te, Pd, Ag and Cu; and (2) employing said nuclei to catalyze the thermal decomposition of a complex to form the visible image, said complex being a complex of tellurium (II) and at least one sulfur containing ligand wherein the tellurium (II) is coordinated to the ligand through the sulfur atom.

DESCRIPTION OF THE PREFERRED EMBODIMENTS

In a preferred embodiment of the present invention, the tellurium (II) complex is coated on an element and is itself photosensitive. Upon exposure, the complex photodecomposes to give elemental tellurium which can then function as a catalyst for the subsequent further thermal decomposition of the tellurium (II) complex by suitable treatment of the exposed element such as heating or treatment with some suitable solvent.

Where the tellurium (II) complex is to be the source of catalytic nuclei, a photoreductant may be incorporated in the element to facilitate the formation of the elemental tellurium catalytic nuclei. In this embodiment the tellurium complex may be either photosensitive or light stable.

As used herein, the term "photoreductant" means a material capable of molecular photolysis or photoinduced rearrangement to generate a reducing agent capable of reducing the tellurium (II) complex, or a reducing agent precursor which can be converted to such a reducing agent.

Useful classes of photoreductants include quinones, disulfides, diazoanthrones, diazophenanthrones, carbazides, diazosulfonates, diazonium salts, aromatic azides, benzimidazoles and aziridines as described in Item No. 12617 of *Research Disclosure,* October 1974, pp. 13–14, and as exemplified in Table I, pp. 14–17 thereof.

Various light-sensitive inorganic compounds are useful as reducing agent precursors. When these compounds are exposed to radiation such as sunlight or UV light, reducing agents are generated that are capable of reducing the tellurium(II) complexes of this invention. Useful inorganic precursor compounds include ferric salts, vanadic, tungstic, and molybdenum compounds and uranium salts as described, for example, in British Pat. No. 670,883, published Apr. 30, 1952. Exemplary compounds include ferric ammonium citrate, sodium metavanadate, sodium molybdate-oxalate and sodium tungstate oxalate.

Conventional inorganic photoconductors such as $TiO_2$ and ZnO may also be employed to photoreduce the Te(II) complexes of this invention. These inorganic compounds are described in *Jour. Electrochem. Soc.,* 121, 1160 (1974) and 122, 1103 (1975) and in U.S. Pat. Nos. 3,652,276 and 3,862,352.

Certain tellurium (II) complexes of the present invention undergo spontaneous decomposition after being exposed to heat. Elements which incorporate these complexes yield an image without the need for further treatment, i.e., they "print out".

In another embodiment, a tellurium complex of the present invention may be coated in an element along with a separate photosensitive compound such as a silver halide, a palladium complex or a copper complex. Exposure of the photosensitive element then produces nuclei which act as a catalyst for the thermal decomposition of the tellurium complex. These elements may be developed by any suitable treatment such as heating or immersion in a solvent.

In still another embodiment, the tellurium complex may be incorporated in a physical developer solution. Elements containing physically developable nuclei may be processed by immersion in these solutions.

PRACTICE OF THE INVENTION

The useful complexes are complexes of tellurium (II), which have a coordination number of four. The complexes are characterized in that at least one of the coordinating ligands coordinates to the tellurium through a sulfur atom. However, complexes useful herein may have any number of the tellurium (II) coordination positions occupied by the sulfur atom of a suitable sulfur containing ligand. The tellurium (II) may therefore be coordinated with a monodenate, bidentate or tridentate sulfur containing ligand or with combinations of these ligands. The tellurium (II) may also be coordinated with a tetradentate sulfur ligand. The sulfur containing ligands may be either neutral or anionic.

Useful monodentate sulfur ligands include neutral Lewis base ligands such as thiourea; substituted thiourea such as ethylene thiourea, N, N'-diphenylthiourea, 1-(1-naphthyl)-2-thiourea, tetramethyl thiourea; 1-methyl-2-thiourea; 1-butyl-2-thiourea and the like. Chelating thioureas, that is ligands containing one sulfur base site and a nitrogen base site are also useful. Suitable ligands of this type inlude 1-(2-pyridyl)-thiourea; N-phenyl-N'-(5-halo-2-pyridyl) thiourea; 1-alkyl-3-(2-pyridyl)-2-thiourea; 1-phenyl-3-(2-pyridyl)-2-thiourea; amidino-2-thiourea; and the like. Other suitable ligands include the thioureas listed in the Eastman Organic Chemicals catalog #47 (1974) on page 322.

Useful bidentate sulfur ligands include anionic bidentate ligands such as thiosulfates, thiosulfonates, dithiocarbamates such as those having the formula $(R'_2NCS_2)^-$ wherein R' is aryl such as phenyl, naphthyl, alkyl having 1-20 carbon atoms including methyl, propyl, isopropyl cyclohexyl and the like; xanthates such as those having the formula $R^2OCS_2)^-$ wherein $R^2$ is alkyl having 1-20 carbon atoms including methyl, propyl, isopropyl, cyclohexyl and the like; dithiophosphates such as those having the formula $((R^2O)_2PS_2)^-$; dithiophosphinates such as those having the formula $(R^2_2PS_2)^-$; dithiocarboxylates such as those having the formula $(R^3CS_2)^-$ wherein $R^3$ is aryl such as phenyl, naphthyl and substituted phenyl, alkyl having 1-20 carbon atoms and the like; dithioalkanes such as those having the formula $R^4$-S$(CH_2)_n$S-$R^5$ wherein n is an integer from 1-6 and $R^4$ and $R^5$ are the same or different and are aryl such as phenyl, naphthyl, substituted phenyl and the like. Other suitable 1,1 and 1,2-dithiobidentate ligands are described in D. Coucouvanis, *Prog. Inorg. Chem.* 11, 233 (1970).

Suitable tridentate sulfur containing ligands include trithioalkanes such as those represented by the formula $R^4$-S$(CH_2)_n$-S-$(CH_2)_n$-S-$R^5$ wherein $R^4$, $R^5$ and n are defined above; 1,1,1-tris(methylthiomethyl) ethane; 1,1,1-tris(phenylthiomethyl) ethane; and the like. Suitable tetradentate sulfur containing ligands include tetrathioalkanes such as those represented by the formula $R^4$-S$(CH_2)_n$S-$(CH_2)_n$-S$(CH_2)_n$-S-$R^5$ wherein $R^4$, $R^5$ and n are as defined above; macrocyclic thioether ligands such as those described in K. Travis and D. H. Busch, Inorg. Chem. 13 2591 (1974); and the like.

Provided that at least one of the coordination positions of the tellurium (II) complex is occupied by a sulfur containing ligand as described above, the remaining positions, if any, may be occupied by either neutral or anionic ligands. Depending on the combination of sulfur containing ligands, neutral ligands and anionic ligands the complexes of the present invention may have a charge of from 0 to 2. Where a complex has a charge other than 0, a neutral salt of the complex is useful herein. Where the complex itself is neutral, it may be used alone. As used herein therefore, "complex" includes neutral complexes or salts of non-neutral complexes.

The particular neutral or anionic ligand that may be used, when desirable, with the sulfur containing ligand or ligands is not critical. Any of a wide variety of ligands known in the art may be used so long as such ligand is compatible with the sulfur ligand. Typical neutral ligands useful herein have group VA or VIA donor atoms. Examples of these ligands are $P(C_6H_5)_3$; 1,10-phenanthroline; 2,2'-bipyridine and the like. Typical anionic ligands include halides such as chloro, bromo and iodo; ions which function like halides such as $(NCO)^-$, $(NCS)^-$, $(NCSe)^-$, $(NCTe)^-$ and the like; cyanoborohydrides such as $(BH_3CH)^-$; hydroborates such as $(BH_4)^-$, $(B_3H_8)^-$, $(B_9H_{14})^-$ and the like; carboxylates such as $(CH_3CO_2)^-$, $(CF_3CO_2)^-$, dicarboxylates such as $C_2O_4^=$ and the like; $(NO_2)^-$; $(NO_3)^-$; $(SO_4)^=$; $(BF_4)^-$; $(B(C_6H_5)_4^-$; $(ClO_4)^-$ $(PF_6)^-$ and the like.

As discussed above, a wide variety of tellurium (II) complexes having sulfur containing ligands are useful in depositing tellurium (O) on catalytic nuclei. Unfortunately many of these complexes are relatively unstable in that they easily hydrolyze. Thus, while they can be used in some photographic processes, they are unsuitable for use in elements coated using aqueous media or coated elements exposed to ambient conditions for long periods.

One group of tellurium (II) complexes wherein the tellurium is bonded to a sulfur containing ligand through the sulfur atom is not only hydrolytically stable but also is capable of catalytic disproportionation. This group includes complexes wherein the tellurium (II) is complexed with two univalent bidentate sulfur containing ligands. The complexes of this group can be prepared by two general methods: 1) ligand reduction of a tellurium (IV) species in aqueous solution with excess of the bidentate sulfur ligand and 2) a substitution reaction using a tellurium (II) coordination complex with weakly bound ligands. In the first method, an especially convenient synthesis involves the formation of an aqueous solution of a tellurium (IV) halo complex by dissolving $TeO_2$ in a warm aqueous hydrohalic acid solution followed by addition of the anionic bidentate sulfur ligand as its potassium or sodium salt. The bidentate sulfur ligand reduces tellurium (IV) to tellurium (II) and the excess ligand allows the formation of the desired tellurium (II) coordination complex which rapidly precipitates from the reaction solution. This crude product is filtered, washed well with water, dried and purified by recrystallization from an appropriate nonaqueous solvent. The reaction temperature used in such syntheses depends on the reducing properties of the bidentate sulfur ligand. For example with xanthates the reaction goes readily at room temperature, while with dithiocarbamates it is necessary to heat the solution for several minutes to effect complete reduction.

In the second method, an especially convenient tellurium (II) reagent for carrying out the substitution reaction is the thiosulfate complex $Na_2Te(S_2O_3)_2.2H_2O$. This material can be readily prepared in large quantities as described in O. Foss, Acta Chem. Scand., 3 708 (1949). The thiosulfate ligands are very weakly bound in this complex and can be readily displaced in aqueous solution by the bidentate sulfur ligands described above. The neutral tellurium (II) complexes which precipitate from these reaction solutions can be isolated and purified as described above. Complexes wherein the tellurium (II) is complexed with two bidentate sulfur containing ligands may conveniently be represented by the general formula:

$$[Te(BL^1)(BL^2)]$$

wherein $BL^1$ and $BL^2$ are the same or different and represent bidentate sulfur containing ligands as defined above. Typical complexes in this group include:

$[Te(S_2COC_2H_5)_2]$
$[Te(S_2P(C_6H_{11})_2)_2]$
$[Te(S_2COC_5H_{11})_2]$
$[Te(S_2CO\text{-}i\text{-}C_3H_7)_2]$
$[Te(S_2CO\text{-}n\text{-}C_{10}H_{21})_2]$
$[Te(S_2CO\text{-}n\text{-}C_{12}H_{25})_2]$
$[Te(S_2P(OCH_3)_2)_2]$
$[Te(S_2P(OC_2H_5)_2)_2]$
$[Te(S_2O_2CH_3)_2]$
$[Te(S_2O_2C_6H_5)_2]$ Another useful group, although not nearly as hydrolytically stable as the group just described, includes complexes wherein the tellurium (II) is complexed with two monodentate ligands which are neutral Lewis bases and contain sulfur donor atoms and with two ligands which are univalent anionic ligands. These complexes may be prepared by methods well known in the art such as by ligand reduction of a tellurium (IV) complex using the appropriate sulfur ligand. Here, as described above, an especially convenient method of synthesizing these complexes is the reaction of the monodentate sulfur ligand with a tellurium (IV) halo complex prepared by dissolving $TeO_2$ in the appropriate aqueous hydrohalic acid. The sulfur ligand, which is used in 5 to 10 fold excess, functions both as the reducing agent (i.e., tellurium (IV)→tellurium (II)) and as a stabilizing ligand for the tellurium product. Such ligand reduction reactions have been described for the synthesis of similar tellurium (II) coordination complexes (i.e., see O. Foss and S. Hauge, Acta Chem. Scand., 13, 1252 (1959) and P. R. Sethuraman et al, Indian J. Chem., 11 288 (1973)). Having formed the halo complex, the two halo ligands can be substituted via metathesis reactions by other anionic ligands such as SCN- and SeCN- etc. Generally the halo complex is isolated first and then added to a concentrated aqueous solution of an alkali metal salt of the desired anion and stirred at room temperature for 0.1–0.5 hr to effect the substitution reaction as described in O. Foss and S. Hauge, Acta Chem. Scand., 13, 1252 (1959); 15, 1615 (1961). Complexes of this second group may conveniently be represented by the general formula:

$$[Te(NML^1)(NML^2)(UAL^1)(UAL^2)]$$

wherein $NML^1$ and $NML^2$ are the same or different and represent neutral Lewis base monodentate ligands containing sulfur donor atoms as defined above, and $UAL^1$ and $UAL^2$ are the same or different and represent univalent anionic ligands as defined above. Typical complexes in this group include:

[Te(thiourea)$_2$(Cl)$_2$]
[Te(thiourea)$_2$(SCN)$_2$]
[Te(1-allyl-2-thiourea)$_2$(Cl)$_2$]
[Te(1,3-diallyl-2-thiourea)$_2$(Cl$_2$]
[Te(1-naphthyl-2-thiourea)$_2$(Br)$_2$]

A third useful group, although again not as hydrolytically stable as the first described group, includes complexes wherein the tellurium (II) is coordinated to four monodentate ligands which are neutral Lewis bases and contain sulfur donor atoms. All four ligands may be the same or there may be two of one ligand and two of another coordinated with the tellurium (II). These complexes have a charge of +2 and form salts with common anions. These complexes are formed by the same method as those of the second group above using a large excess of the desired sulfur ligand. Complexes of this third group may conveniently be presented by the general formula $$[Te(NML^1)_2(NML^2)_2](UAL^1)(UAL^2)$$

wherein $NML^1$, $NML^2$, $UAL^1$ and $UAL^2$ are as defined above. Typical complexes in this group include:

[Te(1-(-naphthyl)-2-thiourea)$_4$]Cl$_2$
[Te(thiourea)$_4$]Cl$_2$
[Te(ethylenethiourea)$_4$]Cl$_2$ Of the groups of complexes described above, complexes of the second and third groups are most useful in room temperature non-aqueous liquid development processes. Thus, these complexes may be included in a physical developer solution or may be incorporated in a catalytic nuclei containing element which is developed by treatment with a suitable solvent. Particularly useful complexes for use in these embodiments include:

[Te(thiourea)$_2$Cl$_2$]
[Te(ethylenethiourea)$_4$]Cl$_2$
[Te(thiourea)$_2$(SCN)$_2$]
[Te(N-phenylthiourea)$_2$Br$_2$]

Some of the complexes of the preferred first group, that is complexes wherein the tellurium (II) is complexed with two bidentate sulfur ligands undergo thermal decomposition even in the absence of a solvent. Thus, they may be incorporated in a catalytic nuclei containing element which is processed by the application of heat alone. Particularly useful complexes for use in this embodiment include:

$[Te(S_2COCH_3)_2]$
$[Te(S_2COC_2H_5)_2]$
$[Te(S_2CO\text{-}i\text{-}C_3H_7)_2]$
$[Te(S_2CO\text{-}n\text{-}C_{16}H_{33})_2]$
$[Te(S_2CO\text{-}n\text{-}C_{18}H_{37})_2)]$
$[Te(S_2P(C_6H_{11})_2)_2]$
$[Te(S_2P(OCH_3)_2)_2]$
$[Te(S_2P(O\text{-}i\text{-}C_3H_7)_2)_2]$
$[Te(S_2P(OC_2H_5)_2)_2]$ Complexes of the preferred first group above which undergo catalytic thermal decomposition at about room temperature (print out) include complexes wherein the tellurium (II) is complexed with dithiophosphate such as $[Te(S_2P(OCH_3)_2)_2]$ and $[Te(S_2P(OC_2H_5)_2)_2]$. When incorporated in a dry imaging element, these complexes form an image within a few seconds after imagewise exposure. No further development steps are necessary.

As used herein, decomposition means the formation of tellurium metal by classical disproportionation which can be represented by the following equation:

$$Te(II)COMPLEX \rightarrow Te(O) + Te(IV)COMPLEX$$

or by ligand reduction of tellurium (II) to tellurium metal which can be represented by the following equation:

$$Te(II)COMPLEX \rightarrow Te(O) + OXIDIZED\ LIGAND$$

Any method of producing nuclei of tellurium, palladium, silver or copper is useful in the practice of this invention. Vacuum deposited metal nuclei images alone can serve as catalytic nuclei for the reduction of the tellurium complexes to tellurium metal. Compounds which are capable of producing these nuclei may be imagewise reduced, such as by a photoreductant, to form the nuclei. Numerous photosensitive compounds which are themselves capable of forming nuclei are also useful in producing the catalytic nuclei according to the present invention. Silver halide emulsions which comprise for example, silver chloride, silver bromide, silver bromoiodide, silver chlorobromide, silver chloroiodide, silver chlorobromoiodide crystals or mixtures thereof are useful herein. Useful techniques for production of silver halide emulsions and addenda for use therein are described in Product Licensing Index, Volume 92, December 1971, publication 9232, pages 107–110 the disclosure of which is hereby incorporated by reference.

Palladium nickel may be generated by the exposure of a wide variety of photosensitive palladium complexes. Palladium complexes which are useful in forming the catalytic nuclei of this invention are described for example in Yudelson et al U.S. Pat. No. 3,719,490; copending application Ser. No. 567,668, filed Apr. 4, 1975 entitled Physical Development of Pd (II) Photosensitive Complexes now U.S. Pat. No. 4,046,564; and B. F. Nellis, Research Disclosure 13705, Sept. 1975. Useful complexes include $(K_2Pd(C_2O_4)_2)$; $[Pd(P(C_6H_5)_3)_2C_2O_4]$; [Pd(1,1,7,7-tetraethyldiethylenetriamine)$N_3$] $(B(C_6H_5)_4)$; and [Pd(1,1,7,7-tetraethyldiethylenetriamine)Cl] $(B(C_6H_5)_4)$.

Similarly, copper nuclei may be generated by the exposure of a wide variety of photosensitive copper complexes. Useful light sensitive copper complexes are described for example in Gysling U.S. Pat. Nos. 3,880,724; 3,860,500; 3,860,501; Gysling et al U.S. Pat. No. 3,859,092. Useful complexes include:

$[Cu(P(OCH_3)_3)_4]B(C_6H_5)_4$
$[Cu(P(OCH_3)_3)BH_3CN]_2$
$Cu(Sb(C_6H_5)_3)_2Cl$
$Cu(As(C_6H_5)_3)_3NO_3$
$Cu(As(C_6H_5)_3)_3BH_3CN.CHCl_3$
$Cu(P(C_6H_5)_3)_2B_3H_8$
$Cu(P(p\text{-tolyl})_3)_2BH_4$
$[Cu(ethylenediamine)_2](B(C_6H_5)_4)_2$
$[Cu(1,3\text{-propanediamine})_2](B(C_6H_5)_4)_2$ According to preferred embodiments of the present invention, the tellurium (II) complex undergoes catalytic decomposition by the application of heat or immersion in a solvent. In these embodiments, an image is formed by heating the complex to a temperature sufficient to decompose the complex in the presence of catalytic nuclei but insufficient to decompose the complex in the absence of the nuclei. Development may be accomplished by heating to about 75° C. to about 200° C. preferably 125° C. to 175° for about 2 to about 60 seconds. The time and temperature may vary with the specific catalyst and complex used and the optimum is easily determined by one skilled in the art. Elements may be heated for example, by passing them between heated rollers or by contacting with a suitable heated surface.

Alternatively, the element containing the nuclei and tellurium complex may be developed by contacting it with a suitable solvent. To be useful, the solvent should be chosen so that the coordination complex and the visible image (tellurium (O)) is insoluble. Useful solvents for such solvent development include dimethylformamide, acetonitrile and alcohols such as methanol and ethanol. The element may be contacted for example by dipping the element in the solvent, by spraying the solvent on the element, or by subjecting the element to vapors of the solvent. The time of development can vary, for example, between about 1 sec. and 60 sec. Development should be terminated before a significant amount of complex begins to develop in the non-exposed areas.

When the tellurium complex is to be the source of catalytic nuclei, a photoreductant may be incorporated to facilitate the formation of elemental tellurium. Since the photoreductant is incorporated in the element for the purpose of facilitating the production of the catalytic image, it may be incorporated in the element in relatively small amounts. It is to be understood that the photoreductant need not be incorporated in the element in an amount sufficient to reduce all of the tellurium complex necessary to form a visible image. The photoreductant is generally present in the range of about 0.5 to about 50 milligrams per milliliter of the solutions containing the tellurium complex.

Any photoreductant can be used. Preferred photoreductants include quinone types with an internal hydrogen source for the hydroquinone formation. Other potential useful photoreductant are those of the quinone type which require a supplementary compound to supply hydrogen for the formation of the hydroquinone reducing agent. Photoreductants of these types are found in Tables 3 and 5 of U.S. Pat. No. 3,880,659 the disclosure of which is hereby incorporated by reference. Other useful photoreductants can be found in U.S. Pat. No. 3,881,930 and British Pat. Nos. 1,373,546 and 1,281,565 the disclosures of which are hereby incorporated by reference. Examples of preferred photoreductants include 4H-benzimidazoles, azidoquinones, 2-isopropoxy-1,4-naphthoquinone and the like.

The photographic elements may contain any of a wide variety of conventional addenda such as thermal solvents, antifoggants, surfactants, and the like. Suitable addenda are described for example in Product Licensing Index, Vol. 92, pages 107–110, December, 1971.

Elements of the present invention may utilize any common photographic support. Typical supports include cellulose nitrate film, cellulose acetate film, poly(vinyl acetal) film, polystyrene film, poly(ethylene terephthalate) film, polycarbonate film or related films or resinous materials. In addition, glass, paper particularly acylated or coated with baryta and/or an alpha-olefin polymer, metal and the like may also be used.

Elements useful according to the present invention may be prepared by imbibing a porous support with the photosensitive composition and/or tellurium complex. For example, a photosensitive element may be prepared by soaking porous paper in a solution containing the photosensitive material and/or the tellurium complex. The paper may then be dried to produce the photosensitive element.

Photographic elements containing the tellurium complexes of the present invention and a photosensitive compound can also be prepared by incorporating the tellurium complexes in the coating composition containing the photosensitive compound. Alternatively, the tellurium complex may be coated in a separate layer or layers using suitable coating compositions. In these embodiments, the tellurium complex should be in reactive association with the catalyst generating photosensitive compound. By "reactive association" it is meant that the tellurium complex is in the same layer as the catalyst and/or in an adjacent layer and/or in a layer that is separated by a layer or layers that are permeable to the reactive components and byproducts. When incorporated in the photographic element, the tellurium complex can be present in the amounts between about 5 mg and about 250 mg/0.093 $m^2$.

A suitable coating composition for the tellurium complex includes the complex along with a binder. Useful binders vary widely and include those binders ordinarily useful in silver halide photography. Since the elements of the present invention need not be processed in aqueous solutions, useful binding agents need not be water permeable, however they must be compatible with the tellurium complexes. By compatible it is meant that the binder must not react with the complex and in the embodiments wherein the complex is itself photosensitive, the binder must transmit the light to which the complex is sensitive. Illustrative binders include polyacetals such as poly(vinyl butyral) and poly(vinyl formal), cellulose esters, gelatin, various vinyl polymers such as poly(vinylidene halides) and the like.

Physical developers containing the tellurium complex may be prepared. These developers are useful in processing elements having thereon the physically developable catalytic nuclei. Suitable solvents include those mentioned above for solvent development. The physical developers are prepared by simply dissolving the complex in the solvent at room temperature. Depending on the particular solvent-complex combination, these physical developers are stable for several hours to several days. When incorporated in physical developers, the tellurium complexes may be present in a concentration of from about 10 mg to 1 g per 100 milliliters of solution.

The following examples are presented for a further understanding of the invention:

EXAMPLE 1

Dichlorobis(thiourea)tellurium (II) was prepared by the addition of thiourea to a solution of $[TeCl_6]^{2-}$ in concentrated HCl as described in O. Foss and S. Hauge, Acta Chem. Scand., 13, 1252 (1959). A solution of 100 mg of the yellow complex in 10 ml dimethylformamide (DMF) was dropped on a microscope slide on which a grid pattern of vacuum evaporated tellurium had been deposited. The latent image areas containing tellurium nuclei immediately became visible on contact with the DMF solution of the complex. By use of a glass slide on which was evaporated a step tablet distribution of elemental tellurium, the minimum coverage of tellurium necessary for initiation of this nonaqueous physical development process was found to be 0.125 mg/0.093 $m^2$.

The preparation of metallic nuclei vacuum-deposited step tablet distributions is described in J. F. Hamilton and P. C. Logel, Thin Solid Films, 23, 89 (1974).

EXAMPLE 2

A sensitized film containing $[TeCl_2(thiourea)_2]$ was prepared by coating a solution of 200 mg of the complex in 15 ml of a 5% DMF solution of Dow Saran F-300 (copolymer of vinylidene chloride and vinyl chloride) on unsubbed poly(ethylene terephthalate) (wet thickness of coating=9 mil). This pale yellow film produced a visible image after a 20 minute exposure under a 360 watt Gates lamp at a distance of 12". This image could be subsequently amplified by heating for 30 seconds at 150° C.

EXAMPLE 3

Sensitized stock was prepared by coating (9 mil wet thickness) a solution of 150 mg of $[TeCl_2\ (thiourea)_2]$ and 150 mg of the photoreductant 2-isopropoxy-1,4-naphthoquinone in 10 ml of a 5% DMF solution of Dow Saran F-300 on unsubbed poly(ethylene terephthalate). The dried film contained 167 mg tellurium per 0.093 $m^2$.

A 60-second Gates lamp exposure of this film at a distance of 12" gave a faint visible image which was converted to a dark brown image on heating the exposed film for 30 seconds at 150° C. Exposures of this photothermographic imaging element with a monochromator at 375 nm followed by processing for 30 seconds at 150° C. produced an image reflection density of 0.2 above fog for an exposure of about $5\times10^5$ ergs/$cm^2$.

EXAMPLE 4

The yellow complex $[Te(SCN)_2(thiourea)_2]$ was prepared by a metathesis reaction between $[TeCl_2(thiourea)_2]$ and KCNS. A solution of 100 mg of the complex in 5 ml of DMF was coated on poly(ethylene terephthalate) on which a series of steps of Pd nuclei had been deposited. All of the steps (lowest coverage=0.0125 mg/$ft^2$) were immediately amplified to black visible images on contact with the solution of the Te(II) complex. Similar catalytic amplification was effected by vacuum deposited Te nuclei.

EXAMPLE 5

This is a comparative example.

Example 4 was repeated with the exception that $$TeCl_2(CH_2\overset{\overset{\displaystyle O}{\|}}{C}C_6H_5)_2$$

was substituted for $[Te(SCN)_2(thiourea)_2]$. No image was formed when either vacuum evaporated palladium nuclei or tellurium nuclei were immersed in the solution. Similarly, no image was produced using $$TeCl_2(CH_2\overset{\overset{\displaystyle O}{\|}}{C}-p-CH_3O-C_6H_4)_2,$$

-continued $$TeCl_2(CH_2\overset{\overset{O}{\|}}{C}-o-CH_3O-C_6H_4)_2,\ Te_2(C_6H_5)_2,\ Te(p-CH_3O-C_6H_4)_2,\ C_6H_5TeCl_3 \text{ or } TeCl_2(p-CH_3-C_6H_4)_2.$$

EXAMPLE 6

Tellurium di(ethylxanthate) $[Te(S_2COC_2H_5)_2]$ was prepared as described in S. Huseby, Acta Chem. Scand., 21, 42 (1967). A solution of 100 mg of the complex in 5 ml dichloromethane was coated on a glass microscope slide on which had been vacuum deposited a grid pattern of tellurium. Upon drying, the complex formed a pale yellow coating on the slide. When the slide was subsequently heated for 30 seconds at 175° C., the latent Te pattern was converted to a visible black grid pattern. A step tablet distribution of vacuum deposited Pd on poly(ethylene terephthalate) was prepared and coated with a solution of the Te(II) complex as described above. All the steps down to 0.056 mg Pd/ft$^2$ were readily amplified to visible images on thermal processing (30 sec., 150° C.).

EXAMPLE 7

A solution prepared by dissolving 100 mg $[Te(S_2COC_2H_5)_2]$ in 10 ml of a 4 percent DMF solution of Poly(vinyl formal) was coated (9 mil wet thickness) on unsubbed poly(ethylene terephthalate) After a 3 minute imagewise exposure with a 360 watt high pressure mercury lamp at a distance of 12", a weak negative image was visible. Subsequent heating for 60 seconds at 135° C. gave a dark brown negative image.

EXAMPLE 8

Enhanced photographic response was obtained by incorporation of 100 mg of the photoreductant 2-isopropoxy-1,4-naphthoquinone in the coating solution of Example 7. Exposures of this sensitized film at 350 nm produced an image reflection density of 0.2 above background fog for an exposure of about $10^6$ ergs/cm$^2$ with thermal processing for 60 seconds at 135° C.

EXAMPLE 9

A solution of $TeO_2$ in concentrated HCl was treated with a 4-fold molar excess of 1-allyl-2-thiourea in water. After concentration of the aqueous solution and dilution with ethanol a white product was crystallized out of the solution upon cooling. The product, which is insoluble in all common organic solvents but readily soluble in water, melts at about 190° C.

A solution of 100 mg of the white complex in 10 ml water was coated on a microscope slide on which had been vacuum evaporated a grid pattern of elemental tellurium. After drying, the slide was heated for 60 seconds at 190° C. to produce amplification of the latent image tellurium depositions to visible black areas with no darkening in the areas on which tellurium had not been vacuum deposited.

Addition of 1,3-diallylthiourea to an aqueous solution of $[TeBr_6]^{2-}$ produced, after a similar workup as described above, a water soluble 1,3-diallythiourea complex of tellurium dibromide. This complex underwent tellurium catalyzed decomposition as described above for the 1-allyl complex.

EXAMPLE 10

An aqueous solution (0.2 g/10 ml) of the 1,3-diallylthiourea complex of tellurium dibromide described in Example 9 was imbibed into a paper stock. After a 30-second imagewise exposure under a 360 watt high pressure mercury arc at a distance of 12", a faint brown negative image formed. Subsequent heating of the exposed paper for 30 seconds at 160° C. produced a brown negative image.

EXAMPLE 11

A film sample containing $[Te(S_2COC_2H_5)_2]$ was prepared by dissolving 300 mg of the complex in 10 ml of a 4 percent solution of poly(vinyl formal) in dichloromethane. This solution was coated (9 mil wet thickness) on unsubbed poly(ethylene terephthalate) and dried. This film was then laminated with a strip of poly(ethylene terephthalate) on which had been vacuum evaporated silver nuclei (0.1 mg/0.093 m$^2$). The laminate, with the silver nuclei and tellurium (II) complex face-to-face, was then heated for 10 seconds at 145° C. by passing through a Cannon Kal Developer. The heated sample blackened only in the area where the silver nuclei and tellurium complex were adjacent.

EXAMPLE 12

The tellurium (II) coordination complex $[Te(1\text{-}(1\text{-naphthyl})\text{-}2\text{-thiourea})_4]Cl_2$ was prepared by reacting an aqueous solution of $[TeCl_6]^{2-}$ (i.e., $TeO_2+HCl$) with excess 1-(1-naphthyl)-2-thiourea. The yellow precipitate was recrystallized from acetone-methanol. A solution of 100 mg of the complex in 10 ml DMF amplified vacuum evaporated tellurium nuclei in 2 minutes and vacuum evaporated silver nuclei in 3 minutes to visible images.

EXAMPLE 13

Tellurium bis(diethyldithiophosphate) was prepared as described in S. Husebye, Acta Chem. Scand., 19, 1045 (1965). The complex was recrystallized from hot ethanol to give orange crystals of the pure material. A solution of 100 mg of the complex in 5 ml of methylene chloride was imbibed into paper stock. Exposure of the resulting yellow colored sensitized paper stock to heat from an Ascorlight 660 Electronic Flash Unit (1 flash) through a silver test negative gave a faint image which spontaneously amplified in about 60 seconds under ambient conditions to a dark brown negative image.

EXAMPLE 14

The complex $[Te(S_2P(C_6H_{11})_2)_2]$ was prepared by the reaction of excess $NH_4^{61}\ S_2P(C_6H_{11})_2^{\ominus}$ (ammonium salt of dicyclohexyldithiophosphinic acid) with $TeCl_6^{2-}$ (i.e., $TeO_2+HCl$) in aqueous solution (4 moles of the ammonium salt:1 mole $TeO_2$). The crude product which precipitated from the aqueous reaction solution was filtered, washed with water, air dried an recrystallized from benzene to give dark red crystals of the pure product.

The utility of this tellurium (II) coordination complex as an amplification element for palladium and silver nuclei was evaluated using a film sample prepared by dissolving 100 mg of the complex in 8 ml of a 4-percent chloroform solution of poly(vinyl formal) and coating this solution (9-mil wet thickness) on unsubbed poly(ethylene terephthalate). Lamination of this film sample face to face with poly(ethylene terephthalate) on which had been vacuum-deposited a step tablet distribution of metallic nuclei and subsequent heating of the sandwich for 30 seconds at 175° C. amplified the metallic nuclei to a visible image.

EXAMPLE 15

A sensitized paper was prepared by imbibition of a solution of 250 mg of the tellurium (II) complex $[Te(S_2P(C_6H_{11})_2)_2]$ in 10 ml of benzene. After a 3-minute imagewise exposure of this sensitized paper stock with a 360 watt high pressure mercury arc (Raymaster 420-Ul, George W. Gates & Co.) at a distance of 12", it was amplified to a black negative image by heating for 30 seconds at 170° C.

A sensitized film sample was prepared by dissolving 100 mg of the complex and 100 mg of the naphthoquinone photoreductant described in Example 3 in 8 ml of a 4 percent chloroform solution of poly(vinyl formal) and coating (9-mil wet thickness) on unsubbed poly(ethylene terephthalate). This film was given a 60 second imagewise exposure with the above mercury arc and then thermally developed (30 seconds, 175° C.) to give a grey negative image.

EXAMPLE 16

The complex $[Te(S_2COCH(CH_3)_2)_2]$ was prepared by the reaction of $Na_2Te(S_2O_3)_2.2H_2O$ and $KS_2COCH(CH_3)_2$ in aqueous solution as described for the ethyl analog in Example 6. The crude product was recrystallized from hot isopropanol-benzene (2:1) to give red needles of the pure product. The potassium isopropylxanthate was prepared by the addition of $CS_2$ to a solution of KOH in isopropanol and the crude product was recrystallized from isopropanol-water (4:1).

The palladium (O) and silver (O) catalyzed thermal decomposition of this complex was evaluated by coating a solution of the complex (50 mg/5 ml $CH_2Cl_2$) on the nuclei which had been vacuum-deposited in step tablet distributions on glass microscope slides. Subsequent heating of the coated slides for 10 seconds at 150° C. produced amplification of the areas containing the nuclei to visible images.

EXAMPLE 17

A dry tellurium amplification element was prepared by dissolving 250 mg of the tellurium complex of Example 16 in 15 ml of a 5 percent chloroform solution of cellulose acetate butyrate and coating (9-mil wet thickness) on unsubbed poly(ethylene terephthalate). A sensitized film was prepared by dissolving 250 mg of $[Cu[P(OCH_3)_3]_4\ B(C_6H_5)_4$ (prepared as described in U.S. Pat. No. 3,860,501) in 15 ml of a 5 percent chloroform solution of cellulose acetate butyrate and coating (8-mil wet thickness) on unsubbed poly(ethylene terephthalate).

After a 15-second imagewise exposure of the above sensitized film under the mercury arc described in Example 15 it was laminated, face to face, with the above tellurium amplification element and passed through a set of heated rollers for 5 seconds at 140° C. A dark brown negative image resulted on the sensitized film.

EXAMPLE 18

The compound $[Te(S_2COC_5H_{11})_2]$ was prepared by the general method described for the isopropyl analog in Example 6. The crude product was recrystallized from n-butanol-benzene (75° C., 4:1) to give orange needles of melting point 51° C.

A film sample containing this tellurium (II) complex was prepared by dissolving 100 mg of the complex in 10 ml of a 5-percent $CHCl_3$ solution of cellulose acetate butyrate and coating the solution on unsubbed poly(ethylene terephthalate) (9-mil wet thicknesses). Lamination of this film with poly(ethylene terephthalate) on which had been vacuum-deposited a step tablet distribution of palladium nuclei and passage of this sandwich configuration through heated rollers at 160° C. for 5 seconds resulted in amplification of the palladium nuclei to a visible image.

Imagewise exposure of the above tellurium containing film for 30 seconds with the mercury arc described in Example 15 produced no visible image but subsequent heating of this exposed film for 10 seconds at 150° C. produced a brown negative image.

EXAMPLE 19

A sensitized film was prepared by dissolving 250 mg of the tellurium (II) complex $[Te(S_2COCH(CH_3)_2)_2]$ and 250 mg of the photoreductant described in Example 3 in 15 ml of a 2% chloroform solution of cellulose acetate butyrate and coating the resulting solution (9-mil wet thickness) on unsubbed poly(ethylene terephthalate). This film was then given a one flash exposure through a silver test negative with the electronic flash unit described in Example 13 at a distance of 3". Subsequent heating of the exposed film at 150° for 5 sec. gave a dark brown negative image.

EXAMPLE 20

The complex $Te(S_2COC_{12}H_{25})_2$ was prepared by an analogous reaction to that described in Example 6 for the ethyl analog using $KS_2COC_{12}H_{25}$. The crude product was recrystallized from isopropanol-benzene (2:1) to give yellow orange needles having a mp of 81° C.

An imaging element containing this complex was prepared by dissolving 100 mg of the complex in 10 ml of a 4% methylene chloride solution of cellulose acetate butyrate and coating this solution (10 mil wet thickness) on poly(ethylene terepthalate). Exposure of this film for 5 min. under the mercury arc described in Example 2 gave a faint grey printout. Processing for 30 sec. at 150° C. gave a black negative image.

Incorporation of 100 mg of the photoreductant 2-isopropoxy-1,4-naphthoquinone in the above coating solution results in enhanced photosensitivity of the imaging layer. With the photoreductant in the coating, the exposure time was reduced from 5 minutes to 30 seconds to give the same image under the same processing conditions described above.

EXAMPLE 21

The complex $Te(S_2COC_{18}H_{37})_2$ was prepared by an analogous reaction to that described in Example 6 for the ethyl analog using $KS_2COC_{18}H_{37}$. The crude product upon recrystallizationfrom toluene gave a yellow solid having a mp of 76° C.

An imaging element containing this complex was prepared by dissolving 100 mg of the complex and 100 mg of the photoreductant 2-isopropoxy-1,4-naphthoquinone in 25 ml of a 4% methylene chloride solution of cellulose acetate butyrate with warming. This solution was coated (10 mil wet thickness) on poly(ethylene terephthalate). Exposure of this sensitized film for 60 sec. with the mercury arc described in Example 2 followed by thermal processing for 30 sec. at 145° C. gave a black negative image.

EXAMPLE 22

The complex bis(allylxanthato)tellurium (II) was prepared by the general procedure described in Example 6 using $KS_2COC_3H_5$. The crude product was recrystallized from methylene chloride-ethanol (1:1) to give a crop of red orange needles.

A solution of 100 mg of this complex dissolved in 10 ml of $CH_2CL_2$ was imbibed into paper stock. After a 30 sec. imagewise exposure of this sensitized paper stock with the mercury arc described in Example 2 and subsequent thermal processing for 30 sec. at 155° C. a brown negative image was obtained.

EXAMPLE 23

A solution containing 150 mg of $[Te(S_2CO\text{-}i\text{-}C_3H_7)_2]$ and 30 mg of [Pd(1,1,7,7-tetraethyldiethylenetriamine)Cl] $B(C_6H_5)_4$ dissolved in 15 ml of acetone was imbibed into paper stock. After a 30 second imagewise exposure with a 360 watt high pressure mercury arc, the paper stock was heated for 5 seconds at 140° C. to give a black negative image.

EXAMPLE 24

A solution containing 200 mg of $[Te(S_2CO\text{-}i\text{-}C_3H_7)_2]$ and 50 mg of $Cu(As(C_6H_5)_3)_3NO_3$ dissolved in 20 ml of $CH_2Cl_2$ was imbibed into paper stock. A 15 sec. imagewise exposure with a 360 watt high pressure mercury arc resulted in a brown negative image. The brown image was amplified to a dense black image by heating the imagewise exposed paper for 5 sec. at 80° C.

EXAMPLE 25

Complexes wherein the tellurium (II) is coordinated to two univalent bidentate sulfur containing ligands exhibit significantly enhanced stability compared to complexes having the general formulae $[Te(NML^1)(NML^2)(UAL^1)(UAL^2)]$ and $[Te(NML^1)_2(NML^2)_2](UAL^1)(UAL^2)$. Complexes containing two univalent bidentate ligands have been isolated from aqueous solution and recrystallized without decomposition from a variety of organic solvents. Purified complexes from this group have been stored under ambient conditions for periods longer than one year without decomposition. Complexes from this group have readily dissolved in various organic solvents and then imbibed into various porous supports or coated with a suitable binder.

In contrast, complexes from the other two groups, e.g. $[Te(thiourea)_2Cl_2]$ exhibit marginal stability. While they have been isolated from aqueous solutions containing a large excess of the sulfur ligand, they readily decomposed within hours to elemental tellurium in aqueous media and in nonaqueous solvents containing even trace amounts of water. While x-ray photoelectron spectroscopy experiments have demonstrated that these complexes undergo catalyzed ligand reduction, their relatively poor hydrolytic stability makes their use impractical in imaging elements particularly those which must be stored under ambient conditions.

The invention has been described in detail with particular reference to certain preferred embodiments thereof, but it will be understood that variations and modifications can be effected within the spirit and scope of the invention.

What is claimed is:

1. A photosensitive element comprising a support having thereon (1) a layer comprising a binder and a compound capable of forming an image of nuclei of one or more metals selected from the group consisting of Te, Pd, Ag and Cu; and (2) a layer comprising a binder and a coordination complex of tellurium (II) and two univalent bidentate sulfur containing ligands, wherein said tellurium (II) is coordinated to said ligands through said sulfur, said layers being in reactive association.

2. An element according to claim 1 wherein said complex is selected from the group consisting of:

$[Te(S_2COC_2H_5)_2]$
$[Te(S_2P(C_6H_{11})_2)_2]$
$[Te(S_2COC_5H_{11})_2]$
$[Te(S_2CO\text{-}i\text{-}C_3H_7)_2]$
$[Te(S_2CO\text{-}n\text{-}C_{10}H_{21})_2]$
$[Te(S_2CO\text{-}n\text{-}C_{12}H_{25})_2]$
$[Te(S_2P(OCH_3)_2)_2]$
$[Te(S_2P(OC_2H_5)_2)_2]$
$[Te(S_2O_2CH_3)_2]$
$[Te(S_2O_2C_6H_5)_2]$

3. An element according to claim 1 further comprising a photoreductant for said compound capable of forming an image of nuclei.

4. An element according to claim 3 wherein said photoreductant is a quinone type with an internal hydrogen source for hydroquinone formation.

5. An element according to claim 1 wherein said compound capable of forming nuclei is a photosensitive compound.

6. An element according to claim 5 wherein said photosensitive compound is a tellurium (II) complex.

7. An element according to claim 5 wherein said photosensitive compound is the same as said tellurium complex.

8. An element according to claim 5 wherein said photosensitive compound and said coordination complex are in the same layer.

9. A photosensitive element comprising a support having thereon a layer comprising a binder and a coordination complex of tellurium (II) and two univalent bidentate sulfur containing ligands wherein said tellurium (II) is coordinated to said ligands through said sulfur.

* * * * *